US006963651B2

(12) United States Patent
Peng

(10) Patent No.: US 6,963,651 B2
(45) Date of Patent: Nov. 8, 2005

(54) SINGLE MAGNETIC CIRCUIT DUAL OUTPUT SPEAKER

(75) Inventor: Jack Peng, Taipei (TW)

(73) Assignee: Meiloon Industrial Co., Ltd., Taipei (TW)

( * ) Notice: Subject to any disclaimer, the term of this patent is extended or adjusted under 35 U.S.C. 154(b) by 14 days.

(21) Appl. No.: 10/673,425

(22) Filed: Sep. 30, 2003

(65) Prior Publication Data

US 2005/0069166 A1 Mar. 31, 2005

(51) Int. Cl.[7] ..... H04R 25/00
(52) U.S. Cl. ..... 381/401; 381/420; 381/186
(58) Field of Search ..... 381/185–186, 381/335, 401–404, 412, 416, 419–420

(56) References Cited

U.S. PATENT DOCUMENTS 3,796,839 A * 3/1974 Torn ..... 381/432
4,590,333 A * 5/1986 Strohbeen ..... 381/186
4,811,406 A * 3/1989 Kawachi ..... 381/186
4,965,837 A * 10/1990 Murayama et al. ..... 381/186
5,548,657 A * 8/1996 Fincham ..... 381/182
6,269,168 B1 * 7/2001 Tagami ..... 381/412
6,647,124 B1 * 11/2003 Peng ..... 381/412
6,744,895 B2 * 6/2004 Miyamoto et al. ..... 381/182
6,801,635 B1 * 10/2004 Minami et al. ..... 381/406
2003/0206641 A1 * 11/2003 Peng ..... 381/182
2004/0047487 A1 * 3/2004 Popken et al. ..... 381/395
2005/0069166 A1 * 3/2005 Peng ..... 381/401

* cited by examiner

*Primary Examiner*—Sinh Tran
*Assistant Examiner*—Phylesha Dabney
(74) *Attorney, Agent, or Firm*—Troxell Law Office, PLLC

(57) ABSTRACT

The present invention discloses an improved single magnetic circuit dual output speaker, comprising a support retainer with an expanded opening at its front end, a bridge disposed across the opening, a magnetic circuit wound and fixed inwardly in the middle of the bridge, a vibrating space disposed on each of both sides of the magnetic circuit, a first voice coil disposed in the vibrating space on one side of the magnetic circuit, a second voice coil disposed in the vibrating space on the other side of the magnetic circuit, a first diaphragm disposed on the expanded opening of the support retainer and having its internal diameter stuck with the first voice coil, a second diaphragm disposed on the expanded opening of the support retainer and having its internal diameter stuck with the second voice coil, and a damper disposed at the back of the support retainer and stuck with the first voice coil, such that the magnetic circuit is mounted at the front of the support retainer by the bridge to provide the dual outputs of high and low pitches by a single body structure, and the bridge can be used to facilitate its holding during assembling and maintenance.

7 Claims, 6 Drawing Sheets

SINGLE MAGNETIC CIRCUIT DUAL OUTPUT SPEAKER

BACKGROUND OF THE INVENTION

1. Field of the Invention

The present invention relates to an improved speaker, more particularly to an improved single magnetic circuit dual output speaker adopting a bridge structure as reinforcement for the design, not only providing a better protection on the magnetic circuit, but also facilitating the grip by holding the bridge during the assembling and maintenance of the speaker.

2. Description of the Related Art

Wonderful music is a major entertainment that enriches our life and relaxes our mind and body. Due to the extensive demand of the market, speaker manufacturers keep on enhancing the output of speakers to stimulate the consumption of the market, and also try their very best to develop more powerful speakers with stylish appearance or sound quality, and therefore new models are introduced to the market from time to time.

Please refer to FIG. 1 for the traditional speaker structure. The magnetic circuit A12 is disposed at the utmost rear of the speaker for dividing the magnetic field by a voice coil A2 in order to produce sound by vibrating the diaphragm A4. Each speaker can be applied for a single function for generating sound, and if we want to differentiate the high pitch from the low pitch, then it requires two speakers; one for the high pitch and the other for the low pitch, not only generating a higher production cost, but also occupying more spaces of the speaker.

In view of the shortcomings of conventional speakers, the inventor of this invention conducted extensive research and development to introduce a new model of improved speaker structure as shown in FIG. 2. The improved speaker structure in accordance with this invention comprises a support retainer G, an expanded opening G1 disposed at the front end of the support retainer G, a damper C disposed at an appropriate position at the rear of the expanded opening g1 for coupling with a voice coil b1, a magnetic circuit F supported by a cylindrical member D and coupled onto the support retainer G, and a vibrating space f1, f2 disposed on each of both sides of the magnetic circuit F, a first voice coil b1 disposed in the vibrating space f1 on one side of the magnetic circuit F, a second voice coil b2 disposed in the vibrating space f2 on the other side of the magnetic circuit F, a first diaphragm g1 disposed on the expanded opening G1 of the support retainer with its internal diameter stuck with the first voice coil b1, and a second diaphragm g2 disposed on the expanded opening G1 of the support retainer with its internal diameter stuck with the second voice coil b2, such that the magnetic circuit F can be protruded from the front of the support retainer G, and the single body structure can be used to provide dual outputs of high and low pitches. Such arrangement is very convenient and capable of saving the assembling space, and thus gaining a high evaluation.

However, the assembly of the single circuit dual output speaker structure is more complicated, and seems to be quite fragile since only a cylindrical pillar is used for the support without the design of any accessory support. The structure of the speaker will be deformed easily when it is collided, and such structure only allows users to hold the outer frame of the expanded opening of the support retainer, and thus making the assembling and maintenance of the speaker very inconvenient.

In view of the description above, the inventor of this invention conducted extensive research and development and experiments, and finally invented this invention.

SUMMARY OF THE INVENTION

The primary objective of the present invention is to provide an improved single magnetic circuit dual output speaker adopting a bridge structure as reinforcement for the design, not only providing a better protection on the magnetic circuit, but also facilitating the holding by the bridge during the assembling and maintenance of the speaker.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
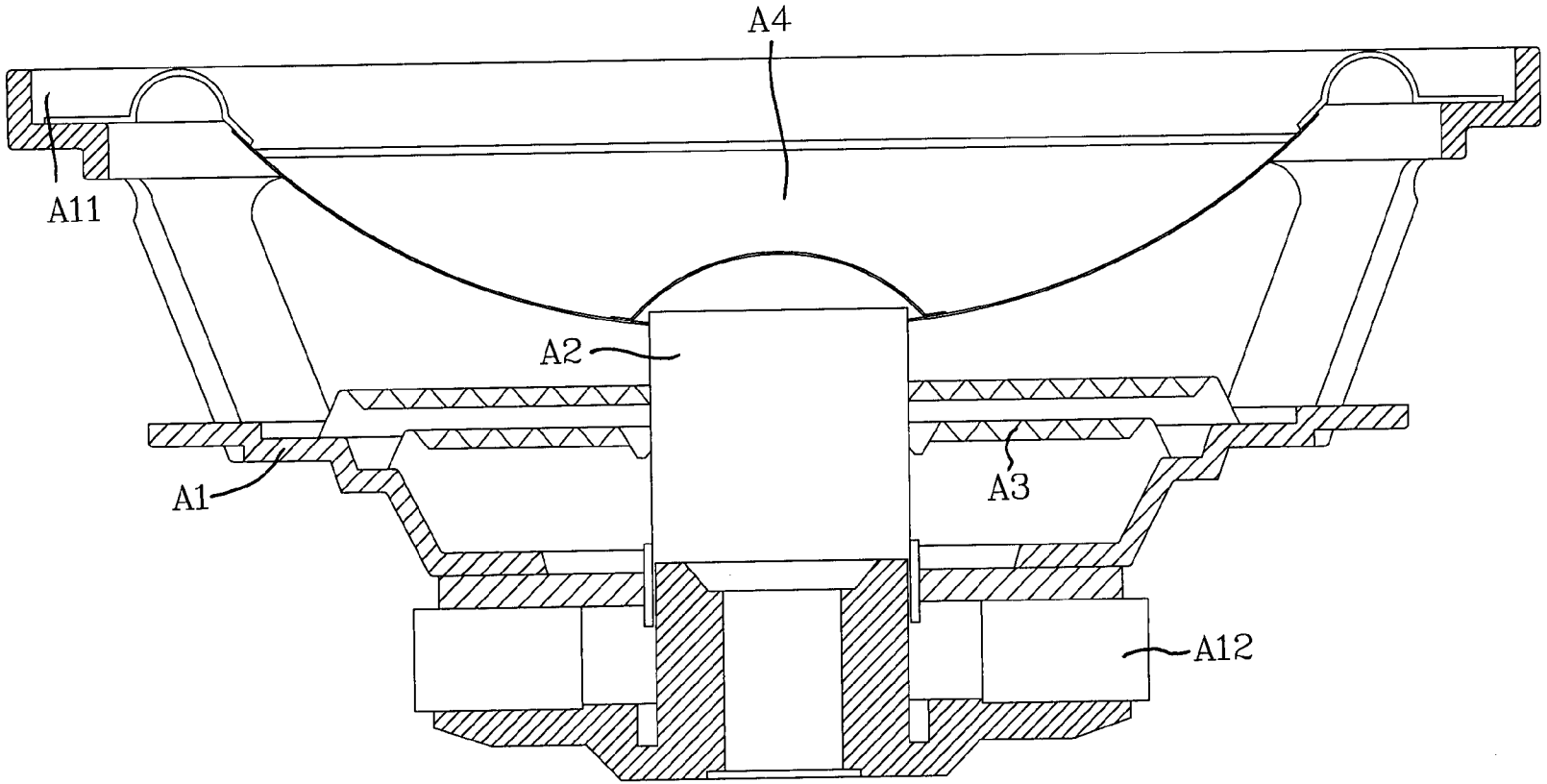
FIG. 1 PRIOR ART
FIG. 1 is a planar diagram of the assembly of a prior-art speaker.
Figure 2:
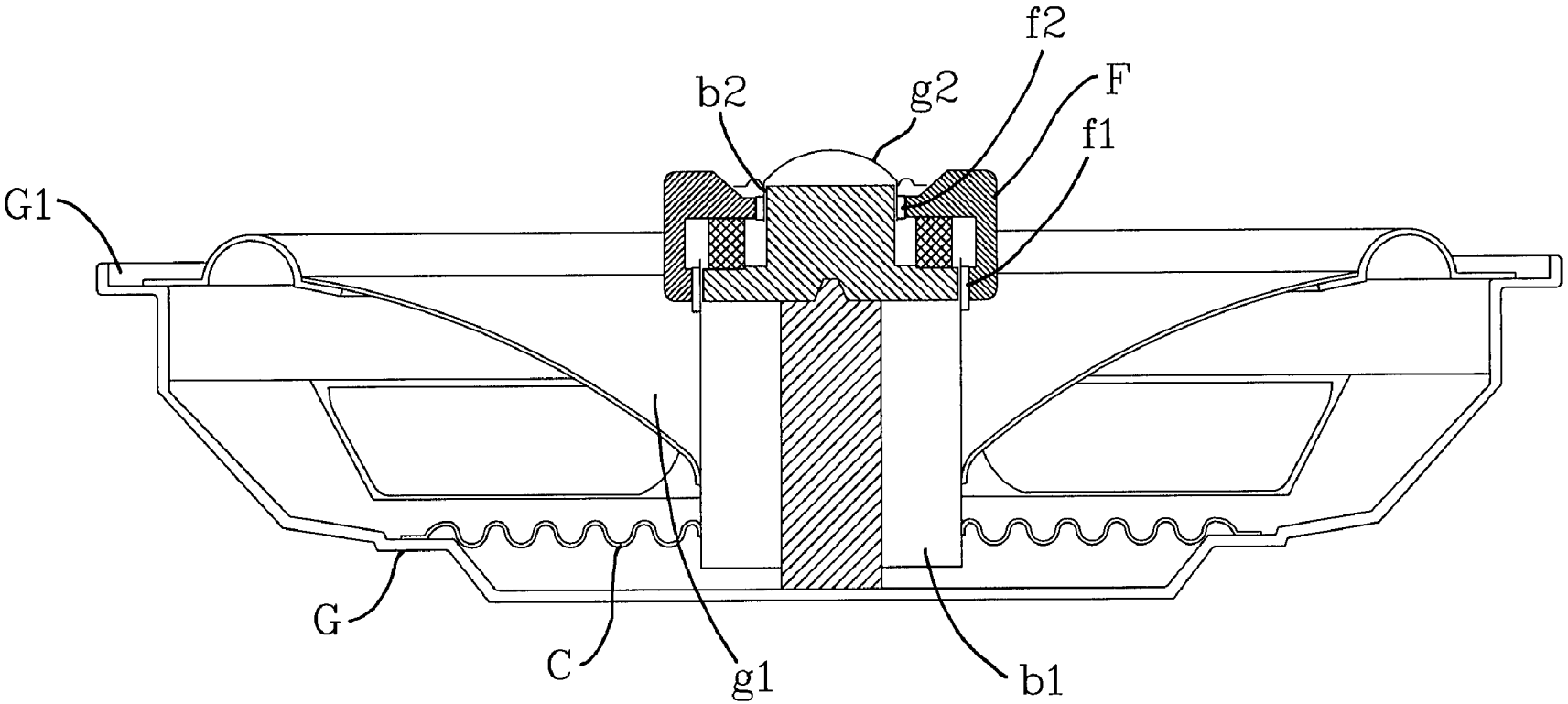
FIG. 2 PRIOR ART
FIG. 2 is a planar diagram of the assembly of a prior-art single magnetic circuit dual output speaker structure.

To make it easier for the examiner to understand the structure, and overall operation of this invention, the specification accompanied by the drawings is described as follows. Please refer to FIGS. 3 to 6. The improved single magnetic circuit dual output speaker in accordance with this invention comprises:

a support retainer 1, further comprising an expanded opening 11 at its front end, a bridge 9 disposed above the expanded opening 11, a magnetic circuit 5 inwardly disposed in the middle of the bridge 9, and a vibrating space 51, 52 disposed on each of both sides of the magnetic circuit 5;

a first voice coil 2, disposed in the vibrating space 51 on one side of the magnetic circuit 5;

a second voice coil 6, disposed in the vibrating space 52 on the other side of the magnetic circuit 5;

a first diaphragm 7, disposed above the expanded opening 11 of the support retainer and its internal diameter being stuck with the first voice coil 2;

a second diaphragm 8, disposed on the magnetic circuit 5 and its internal diameter being stuck with the second voice coil 6; and a damper 3, disposed at an appropriate position on the rear of the support retainer 1 and stuck with the first voice coil 2; thereby when the magnetic circuit 5 is assembled, the magnetic circuit can be mounted at the front end of the support retainer 1 by the bridge 9, and the single body structure can be used to provide the dual outputs for high and low pitches, and the bridge 9 can be used for facilitating the holding of the speaker for assembling and maintenance. Compared with the prior-art design, the structure of this invention is stronger, more useful, and has improvement over the prior art.

Figure 3:
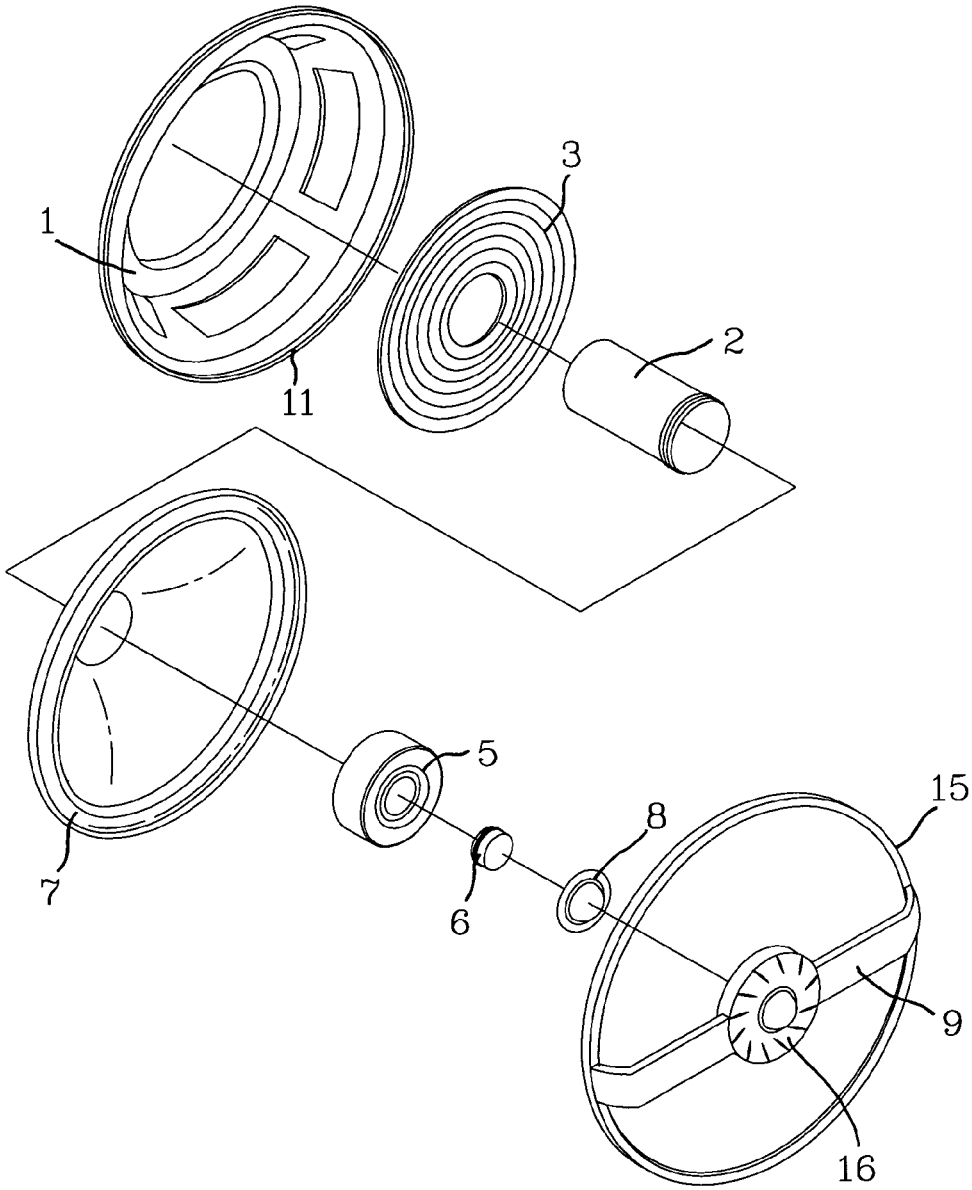
FIG. 3 is a perspective diagram of the disassembled parts of the speaker structure according to the present invention.
Figure 4:
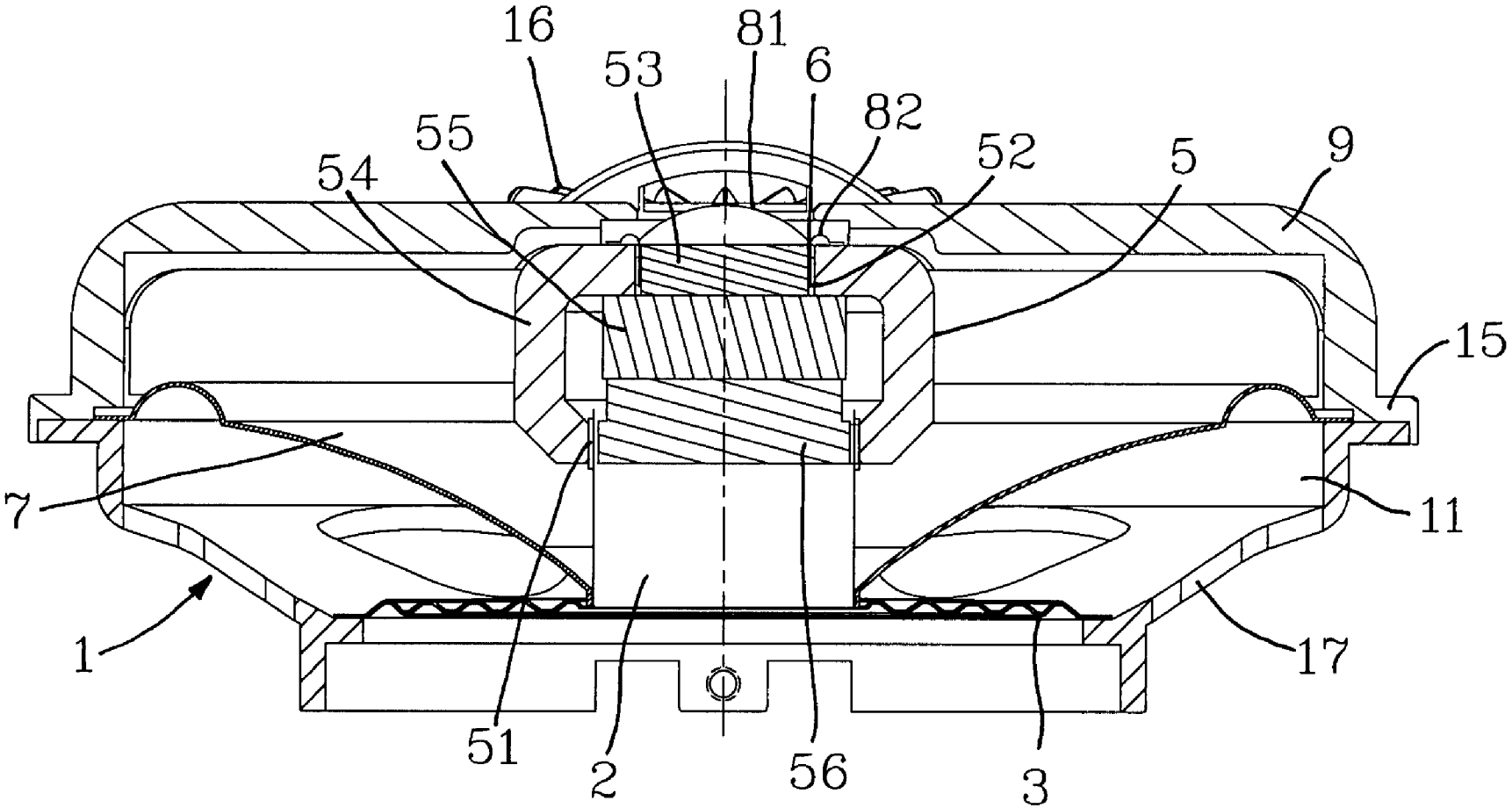
FIG. 4 is a planar diagram of the assembled speaker according to the present invention.

Please refer to FIGS. 3 and 4 for a preferred embodiment of this invention. In the figures, the support retainer 1 could adopt a circular cover 15 in the front end, and a trumpet-shaped base 17 at the rear end, and a set of a small circular cover 16 and a magnetic circuit 5 disposed in the middle of a bridge 9 of the circular cover 15, and such first diaphragm 7 could be a general diaphragm for low pitches and in a bowl shape having an aperture at the center of its bottom, and such second diaphragm 8 could be a diaphragm for high pitches having a protruded ring 81 on a circular plate for surrounding a circular protrusion 82 at its center.

Further, the first and second voice coils 2, 6 could be designed as different diameters and lengths, such that the magnetic circuit 5 is comprised of a sleeve 54 with a hole of different size at both ends, a ring-shaped magnet 55 disposed in the interior, and two caps 53, 56 covering the holes on both ends, such that after the caps 53, 56 are aligned with the sleeve 54, the vibrating spaces 52, 51 so produced at the upper and lower sections can fit different sizes.

Figure 5:
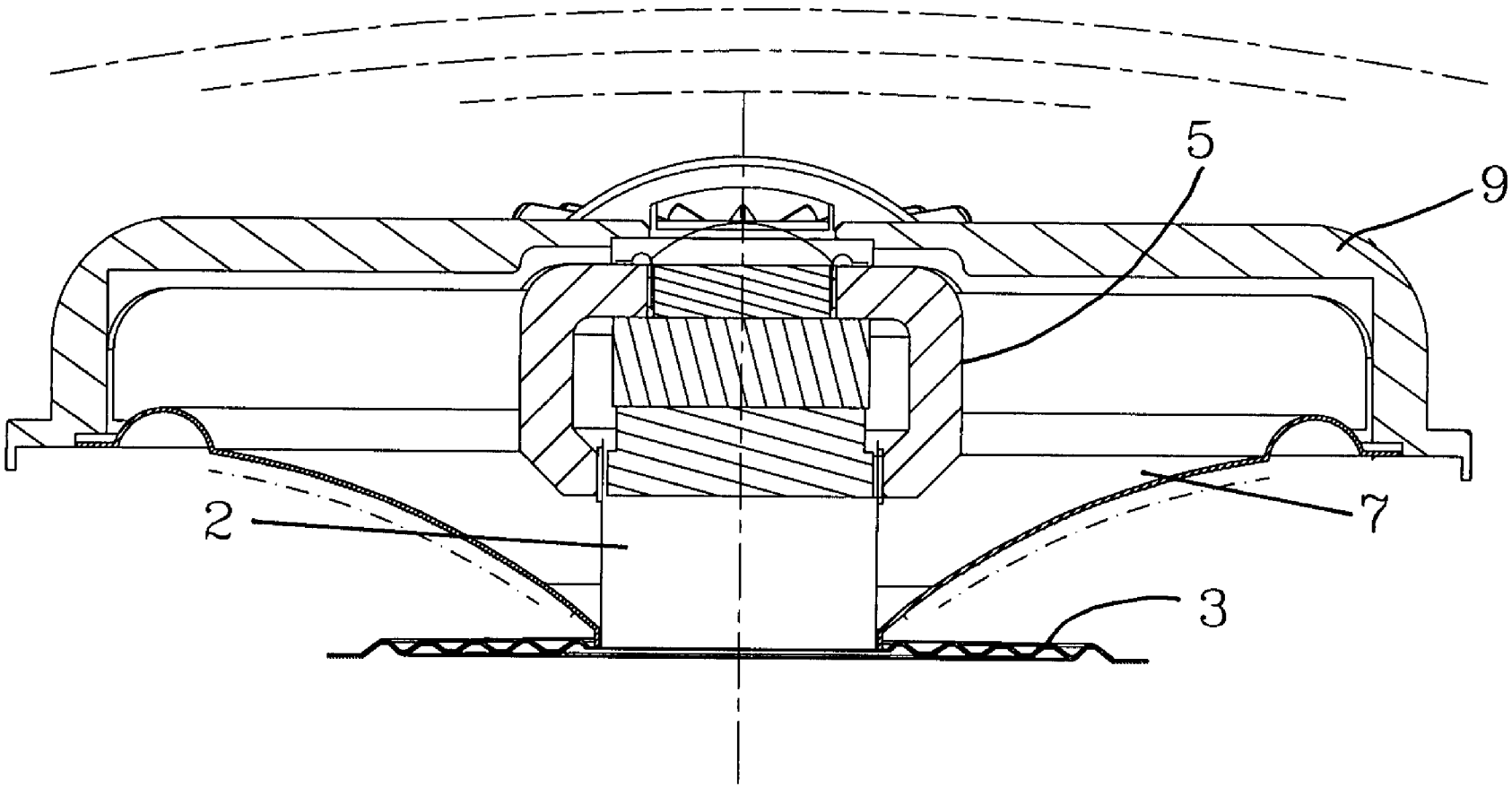
FIG. 5 is an illustrative diagram of the movement of the low-pitch diaphragm according to the present invention.
Figure 6:
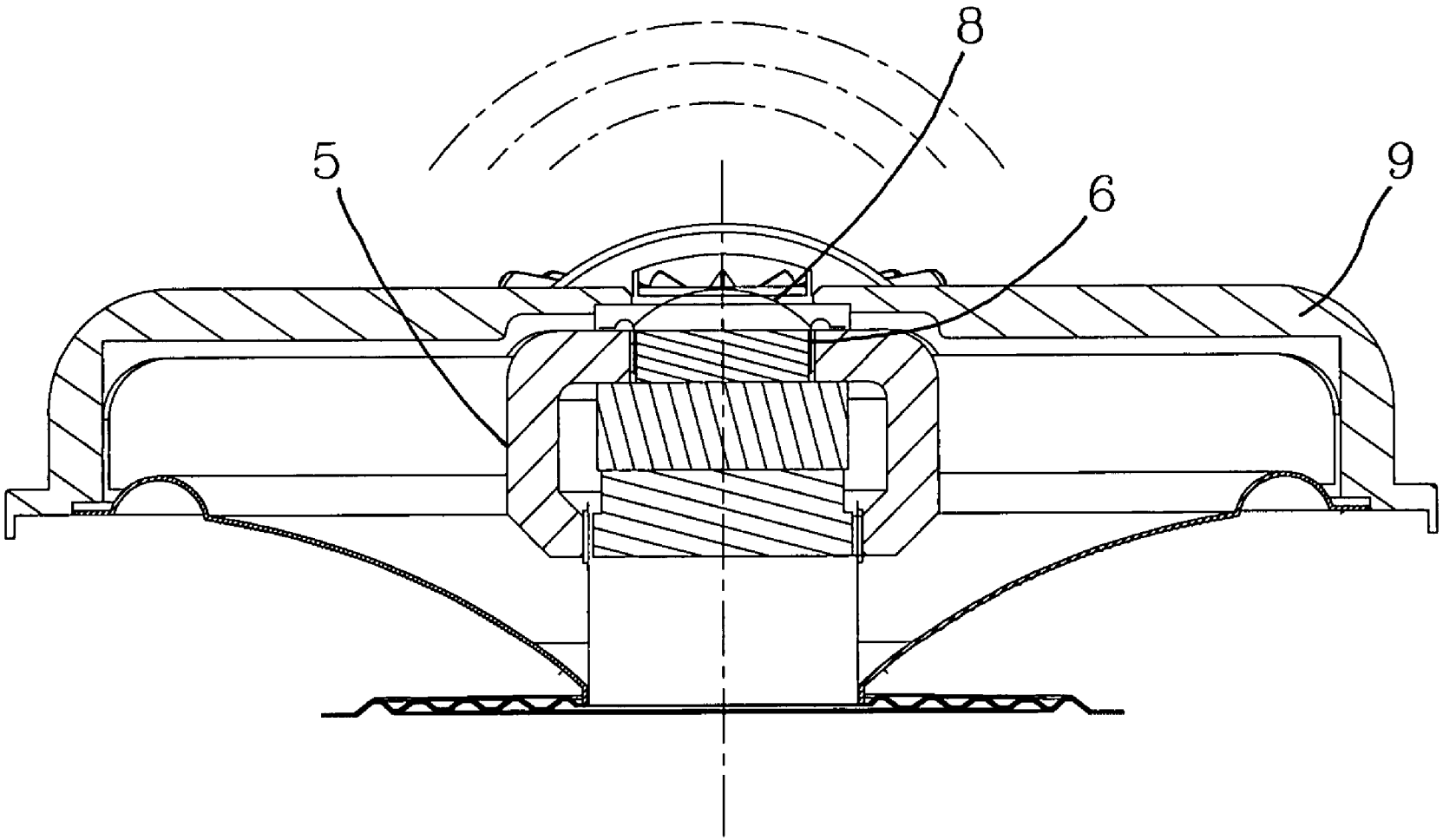
FIG. 6 is an illustrative diagram of the movement of the high-pitch diaphragm according to the present invention.

Please refer to FIGS. 4 to 6. After the speaker is assembled, the magnetic circuit 5 can be set at the front end of the support retainer 1 to respectively push the second and first voice coils 6, 2 by the upper and lower sections, such that the first voice coil 2 drives the first diaphragm 7 to produce an output of low pitches, and the second voice coil 6 drives the second diaphragm 8 to produce an output of high pitches, and thus achieving the dual output effect produced by a single body structure.

In summation of the description above, this invention effectively improves the structure of a single body speaker structure to produce the dual outputs of high and low pitches, and its structure adopts the bridge design for reinforcement, not only providing a strong protection to the magnetic circuit, but also using the bridge to provide a grip for holding the speaker for assembling and maintenance. The entire space configuration of this invention is novel, and further complies with the patent application requirements and is submitted to the Patent and Trademark Office for review and granting of the commensurate patent rights.

While the present invention has been described by the most practical and preferred embodiments, it is understood that this invention is not limited to the disclosed embodiments but is intended to cover various arrangements included within the spirit and scope of the broadest interpretations and equivalent arrangements.

What is claimed is:

1. An improved single magnetic circuit dual output speaker structure, comprising:

a support retainer, further comprising an expanded opening at its front end, a bridge disposed above said expanded opening, a magnetic circuit wound and fixed inwardly in the middle of the bridge, a vibrating space disposed on each of both sides of said magnetic circuit;

a first voice coil, disposed in said vibrating space on the top of said magnetic circuit;

a second voice coil, disposed in said vibrating space on the bottom of said magnetic circuit;

a first diaphragm, disposed on said expanded opening of said support retainer and having its internal diameter stuck with said first voice coil;

a second diaphragm, disposed on said expanded opening of said support retainer and having its internal diameter stuck with said second voice coil; and a damper, disposed at the back of the support retainer and stuck with said first voice coil, such that said magnetic circuit being mounted at the front of said support retainer by said bridge to provide the dual outputs of high and low pitches by a single body structure, and the bridge being used to facilitate the grip for its holding during assembling and maintenance, wherein said support retainer is a two-piece member having a circular cover at its front end, and a trumpet-shaped base at its rear end, and a small circular cover is disposed in the middle of said bridge of said circular cover to pair with said magnetic circuit.

2. The improved single magnetic circuit dual output speaker structure of claim 1, wherein said first and second voice coils are of different diameters and lengths, and comprised of a ring-shaped magnet disposed on both ends having a sleeve of different sizes, and two caps being covered the ends of two holes.

3. The improved single magnetic circuit dual output speaker structure of claim 1, wherein said first diaphragm is in the shape of a bowl and has an aperture at the center of its bottom, and said second diaphragm is a circular plate having a protruded ring to surround a circular protrusion at the center.

4. A single magnetic circuit dual output speaker structure comprising:

a) a support retainer having:

i) an expanded opening on a front thereof; and ii) a bridge located over a from of the expanded opening;

b) a magnetic circuit located in a middle of the bridge and having:

i) a first vibrating space located on a bottom thereof; and ii) a second vibrating space located on a top thereof;

c) a first voice coil located in the first vibrating space of the magnetic circuit;

d) a second voice coil located in the second vibrating space of the magnetic circuit;

e) a first diaphragm located in the expanded opening of the support retainer and having an interior diameter connected to the first voice coil;

f) a second diaphragm located above the expanded opening of the support retainer and having an interior diameter connected to the second voice coil; and g) a damper located on a back of the support retainer and connected with the first voice coil, wherein the magnetic circuit provides dual outputs of high and low pitches.

5. The single magnetic circuit dual output speaker structure according to claim 4, wherein the first voice coil has a length and a diameter that is different from a length and a diameter of the second voice coil, the magnetic circuit including a sleeve and a ring-shaped magnet located within the sleeve, the sleeve having two holes and two caps, one of the two caps covering each of the two holes.

6. The single magnetic circuit dual output speaker structure according to claim 4, wherein the first diaphragm having a shape of a bowl and an aperture at a center of a bottom thereof, the second diaphragm is a circular plate having a protruding ring at a center thereof and a circular protrusion located on an outer periphery of the protruding ring.

7. The single magnetic circuit dual output speaker structure according to claim 4, wherein the support retainer includes a circular cover connected to the bridge, a trumpet-shaped base connected to the circular cover, the bridge having a small circular cover located in the middle of the bridge and aligning with the magnetic circuit.

* * * * *